US006212691B1

(12) United States Patent
Heberer

(10) Patent No.: US 6,212,691 B1
(45) Date of Patent: Apr. 10, 2001

(54) PORTABLE URINAL FOR TREE STAND OR OTHER ELEVATED PLATFORM

(76) Inventor: Michael S. Heberer, 690 E. County Rd. 1630, Hamilton, IL (US) 62341

( * ) Notice: Subject to any disclaimer, the term of this patent is extended or adjusted under 35 U.S.C. 154(b) by 0 days.

(21) Appl. No.: 09/366,988

(22) Filed: Aug. 4, 1999

(51) Int. Cl.[7] ..... A47K 11/00

(52) U.S. Cl. ..... 4/144.1; 4/144.2; 4/144.3; 4/144.4

(58) Field of Search ..... 4/144.1–144.4, 4/476, 271; 220/827–832

(56) References Cited

U.S. PATENT DOCUMENTS

| | | | | |
|---|---|---|---|---|
| 190,244 | | 5/1877 | Olmstead . | |
| 1,440,765 | | 1/1923 | Buckley . | |
| 2,522,273 | | 9/1950 | Johnson . | |
| 2,685,386 | * | 8/1954 | Lisciani | 220/832 |
| 2,734,198 | | 2/1956 | Kutsche . | |
| 4,145,768 | | 3/1979 | Chevrette . | |
| 4,375,705 | * | 3/1983 | Warax | 4/271 |
| 4,656,675 | | 4/1987 | Fajnsztajn . | |
| 4,771,484 | | 9/1988 | Mozell . | |
| 4,908,882 | * | 3/1990 | Williams et al. | 4/271 |
| 5,091,998 | | 3/1992 | Irazabal . | |
| 5,309,578 | | 5/1994 | Temple, Sr. . | |
| 5,797,147 | * | 8/1998 | Young et al. | 4/144.1 |
| 6,021,529 | * | 2/2000 | Abbato | 4/144.1 |

* cited by examiner

*Primary Examiner*—Gregory L. Huson
*Assistant Examiner*—Tuan Nguyen
(74) *Attorney, Agent, or Firm*—Zarley, McKee, Thomte, Voorhees & Sease

(57) ABSTRACT

A portable urinal device for use in a tree stand or other elevated platform that controls both noise and odor problems associated with the urinary function. The portable urinal device includes a generally funnel-shaped container having a top end that is open and a lid hingeably mounted on the container for moving between a closed position and an open position. The lid of the portable urinal device is biased toward the closed position to facilitate use of the device with one hand in its preferred form, the lid includes a lever with a locking mechanism that engages the container to lock the lid in the open position during urination. The portable urinal device may be used with a fluid hose with one end buried underground to facilitate the disposal of urine.

16 Claims, 4 Drawing Sheets

PORTABLE URINAL FOR TREE STAND OR OTHER ELEVATED PLATFORM

BACKGROUND OF THE INVENTION

1. Field of the Invention

The present invention relates to urinals. More particularly, though not exclusively, the present invention relates to a portable urinal for use in a tree stand and other elevated platforms.

2. Problems in the Art

Tree stands are commonly used in hunting, photography and various other nature activities. For example, deer hunters often hunt from tree stands. Hunters and other persons may remain on the stand for considerable periods of time. It may become necessary for the person to urinate while on the tree stand. Although portable urinals are well known, such prior art urinals have deficiencies and are not well-suited for use in a tree stand or other elevated platforms.

While in a tree stand, it is important to remain undetected. Animals should not see, hear or smell the person in the tree stand. Unfortunately, prior art portable urinals do not serve to accomplish these goals. One means for dealing with the problem is to carry a bottle or container into the tree stand for urination. The container of urine is later carried away from the stand for proper disposal. Using a bottle having a separate lid requires that the tree stand-sitter perform lots of unnecessary movements. Other problems include dropping the bottle or cap of the bottle while in the tree stand, filling the container before the tree stand-sitter is ready to leave the stand, and simply forgetting to take the bottle from the tree stand when finished. Thus, there is a need in the art for an improved portable urinal that minimizes noise, as well as the amount of movement required during urination, and is easy to use.

Of course, a tree stand-sitter could simply urinate directly onto the ground or against the side of the tree. Such a method creates unwanted noise. In addition, it does nothing to control the odor of the urine. Animals are generally sensitive to the smell of human urine. For this reason, it is preferable that any urine is disposed of in a way that controls its odor. Thus, there is also a need in the art for a improved portable urinal that controls the problems associated with odor in the disposal of the urine.

FEATURES OF THE INVENTION

A general feature of the present invention is the provision of a portable urinal device and method for using the same that overcomes the problems found in the prior art.

A further feature of the present invention is the provision of a portable urinal device and method for using the same that minimizes the amount of movement associated with the urinary function.

A further feature of the present invention is the provision of an improved portable urinal device and method for using the same that reduces the noise associated with the urinary function.

A still further feature of the present invention is the provision of an improved portable urinal that is easy and convenient to use.

A further feature of the present invention is the provision of an improved portable urinal device and method for using the same that controls the odor of the urine.

These as well as other features and advantages of the present invention will become apparent from the following specification and claims.

SUMMARY OF THE INVENTION

The portable urinal device of the present invention includes a generally funnel-shaped container having a top end that is open and a lid hingeably mounted on the container for movement between a closed position and an open position. The lid of the portable urinal device is biased toward the closed position to facilitate use of the device with one hand. In its preferred form, the lid includes a lever with a locking mechanism that engages a handle on the container to hold the lid in the open position during urination. The portable urinal device may also include a flexible gasket disposed between the container and the lid to provide a tight seal for controlling odor, as well as to dampen any sound vibrations when the lid is closed. In its preferred form, the portable urinal device of the present invention also includes a discharge nipple at the bottom end of the container and a fluid hose connected thereto for directing urine to the ground below. The fluid hose may be buried underground to reduce noise and prevent odor problems. A mounting mechanism may also be included so that the portable urinal device can be easily stored away when not in use.

The present invention also includes a method of disposing of urine from a hunting stand. The method generally includes the steps of providing a portable urinal device and fluid hose as described above, connecting one end of the fluid hose to the bottom end of the container, burying the other end of the fluid hose underground, opening the lid of the container, engaging the locking mechanism to hold the lid in the open position, urinating into the container, disengaging the locking mechanism, and closing the lid on the container. The claimed method minimizes both the sound and odor problems associated with the urination function.

DETAILED DESCRIPTION OF THE PREFERRED EMBODIMENT

The present invention will be described as it applies to its preferred embodiment. It is not intended that the present invention as claimed be limited to the described embodiment. It is intended that the invention will cover all modifications and alternatives included within the spirit and scope of the invention.

Figure 1:
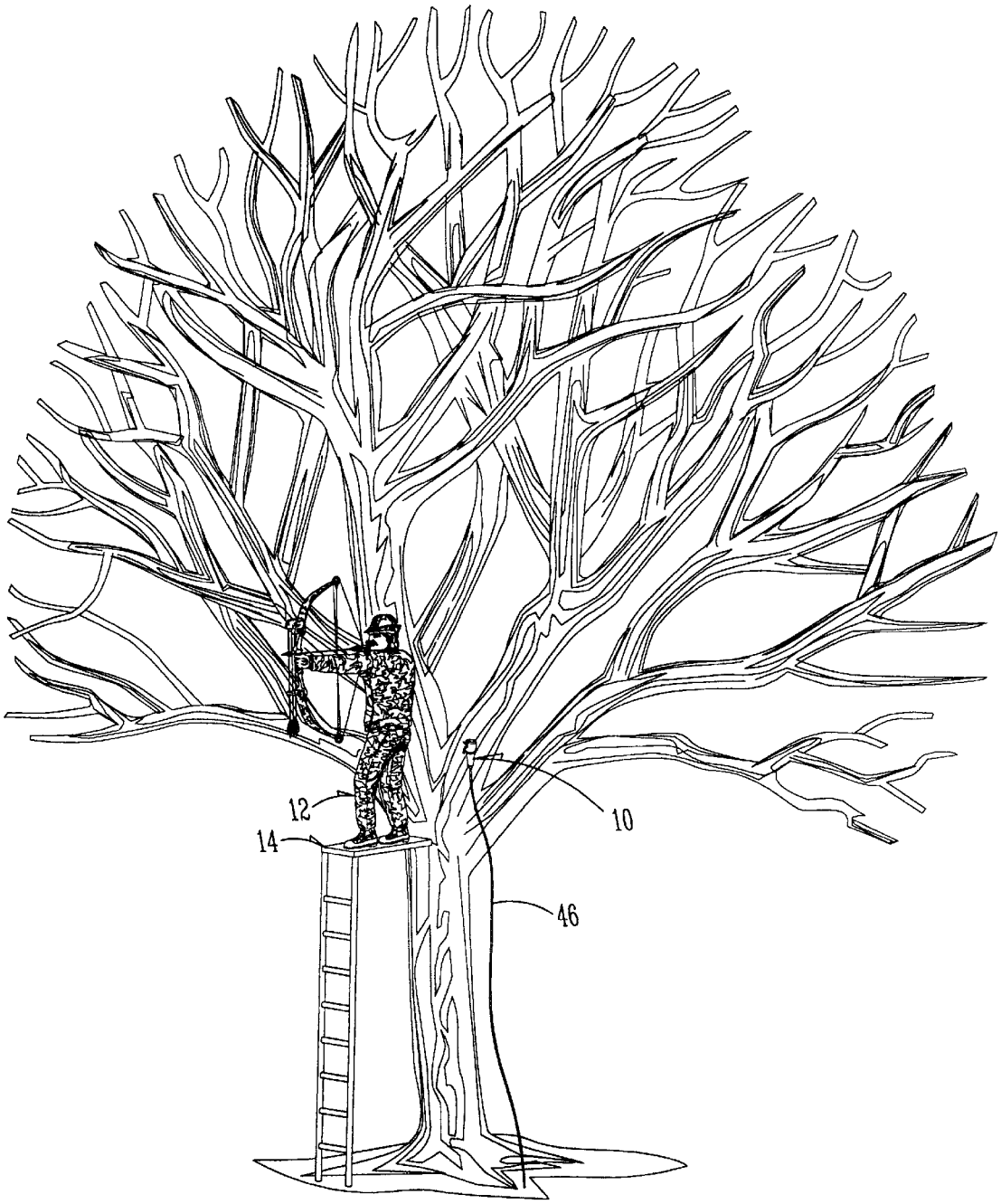
FIG. 1 is a pictorial view of a portable urinal device of the present invention for use by a hunter in a tree stand.

Now referring to the drawings, FIG. 1 shows a portable urinal device 10 of the present invention for use by a hunter 12 in a tree stand 14. The portable urinal device 10, shown in more detail in FIG. 2, includes a generally funnel-shaped container 16 having a top end 18 and a bottom end 20. The container 16 includes a handle 22 disposed near the top end 18. The container 16 is hollow with an opening at both its top end 18 and bottom end 20. The top end 18 is slanted downwardly away from the handle 22 so that the container 16 can be easily and quickly oriented in the proper position for urination.

Figure 2:
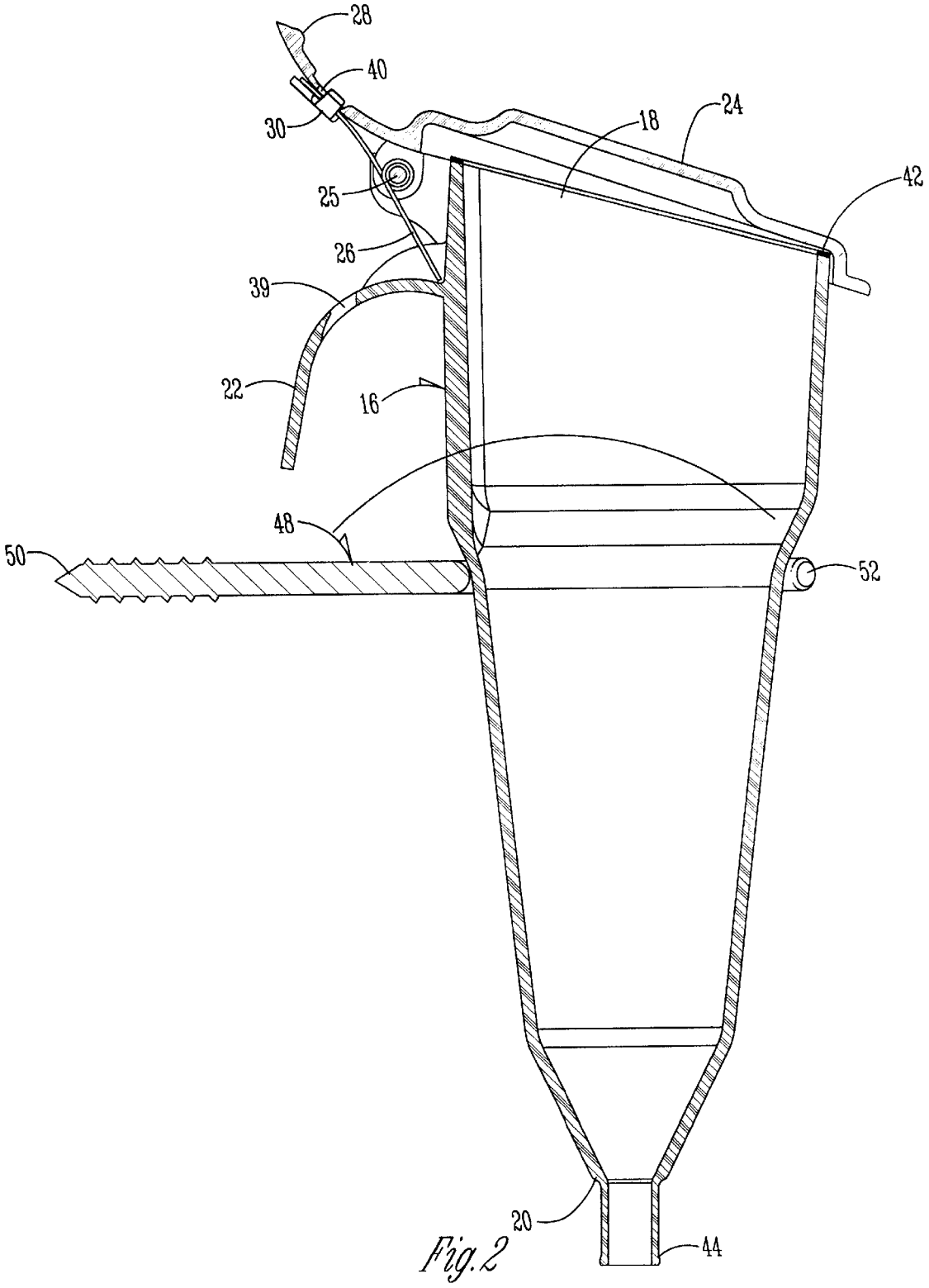
FIG. 2 is a partial sectional view of the portable urinal device of the present invention with the lid in a closed position.
Figure 3:
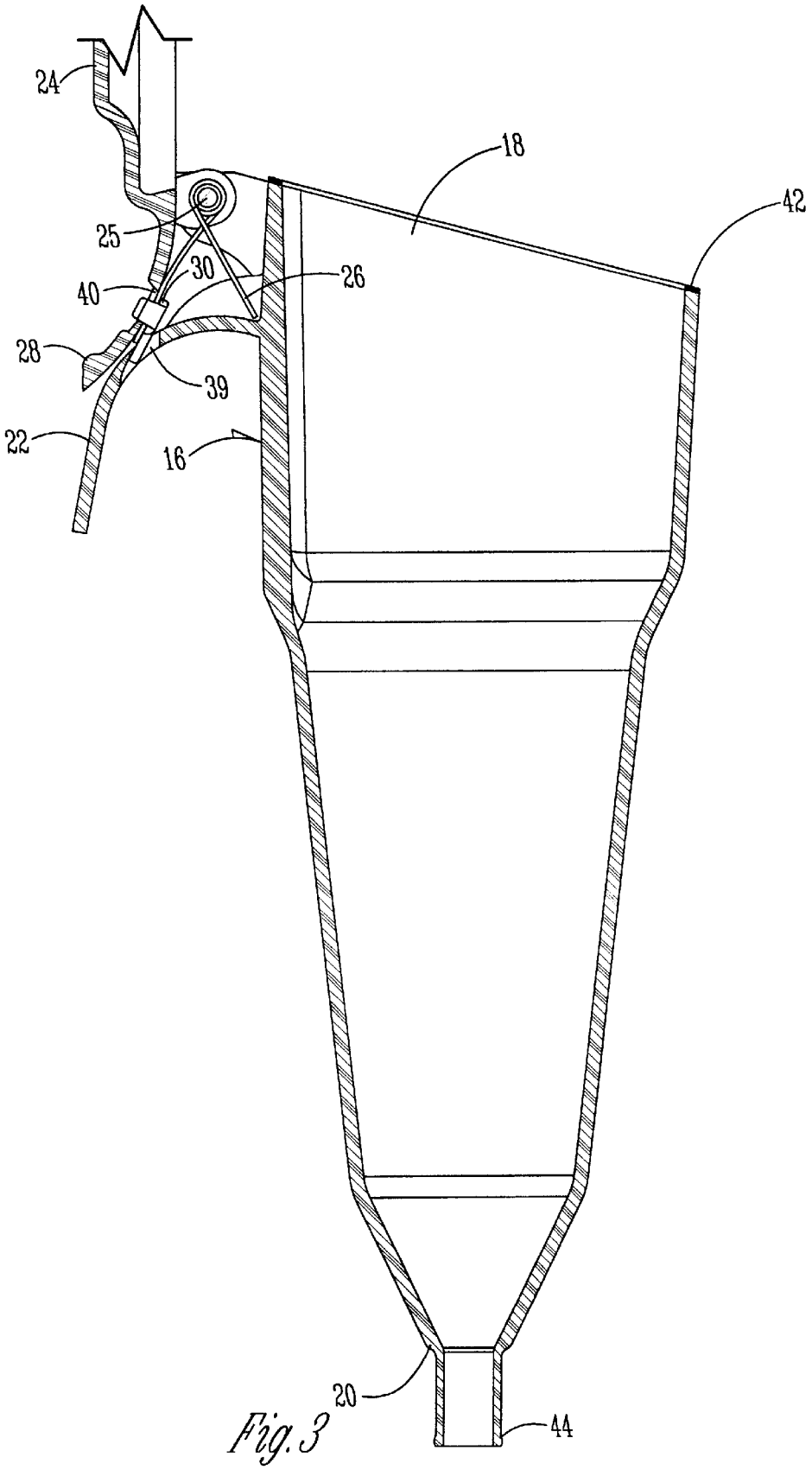
FIG. 3 is a sectional view of the portable urinal device with the lid in an open position.

The portable urinal device 10 also includes a lid 24 that hinges about a pin 25. The lid 24 pivots between a closed position and an open position, as shown in FIGS. 2 and 3 respectively. The lid 24 is biased toward the closed position by means of a torsion spring 26.

The lid 24 includes a lever 28 having a locking mechanism 30 slidably mounted thereon. The locking mechanism 30 includes a base wall 32, tongue portion 34 and opposing wings 36. As illustrated in FIG. 3, when the lid 24 is in the open position, the locking mechanism 30 can be slid down so that the tongue portion 34 is inserted into an aperture 39 in the handle 22 of the container 16. In this position, the tongue portion 34 of the locking mechanism 30 abuts the bottom surface of the handle 22 and locks the lid 24 in the open position. To return the lid 24 to the closed position, the locking mechanism 30 is slid forward so that the tongue portion 34 is removed from the aperture 39 in the handle 22, and the lid is allowed to pivot to the closed position.

Figure 5:
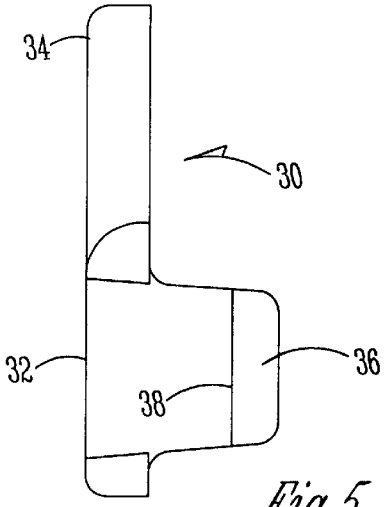
FIG. 5 is a side elevational view of the locking mechanism shown in FIG. 4.
Figure 4:
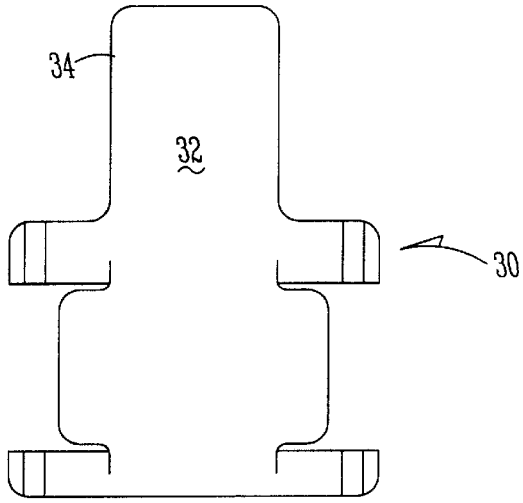
FIG. 4 is a top elevational view of the locking mechanism used with the present invention.
Figure 6:
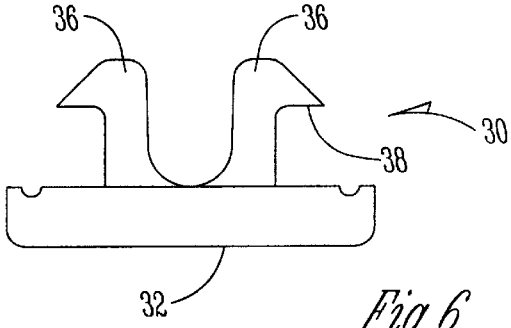
FIG. 6 is an end elevational view of the locking mechanism shown in FIG. 4.

The details of the preferred locking mechanism are shown in FIGS. 4–6. As described previously, the locking mechanism 30 includes a base wall 32 having a tongue portion 34. Extending generally orthogonal from the base wall 32 are two opposing wings 36. Each of the wings 36 has a barb 38 for gripping the top surface of the lever 28 when inserted through the aperture 40 in the lever. The wings 36 are yieldably biased against opposing edges of the aperture 40 with the wings sized smaller than the aperture such that the locking mechanism 30 can slide along the lever 28. In operation, the hunter 12 can use his thumb or other finger to contact the wings 36 and slide the locking mechanism 30 into the proper position.

It can be appreciated by those skilled in the art that the locking mechanism disclosed is but one of several possible locking mechanisms. However, the disclosed locking mechanism 30 is preferred because it allows the hunter 12 to both hold the portable urinal device 10 and open and close the lid 24 with one hand.

A flexible gasket 42, such as one made of polyurethane or neoprene, is disposed at the top end 18 of the container 16 between the container and the lid 24. The flexible gasket 42 provides a tight seal to contain odors in the container, and also muffle any sound made by the lid 24 closing on the container 16.

As shown in FIGS. 2 and 3, the bottom end 20 of the container 16 includes a discharge nipple 44. The discharge nipple 44 is adapted to receive the end of a fluid hose 46 to carry urine or other fluids out of the container 16. The opposite end of the fluid hose is preferably buried underground to contain the odor of the urine (see FIG. 1). This feature of the invention not only prevents problems associated with urine odor, but the fluid hose 46 also helps to muffle sounds associated with the urinary function. Although the conventional wisdom is that deer can distinguish human urine from animal urine, some hunters believe that it is desirable for human urine to be disposed on top of the ground near the tree stand. Of course, the fluid hose 46 of the present invention can be easily adapted to simply allow the urine to fall on top of the ground.

Figure 7:
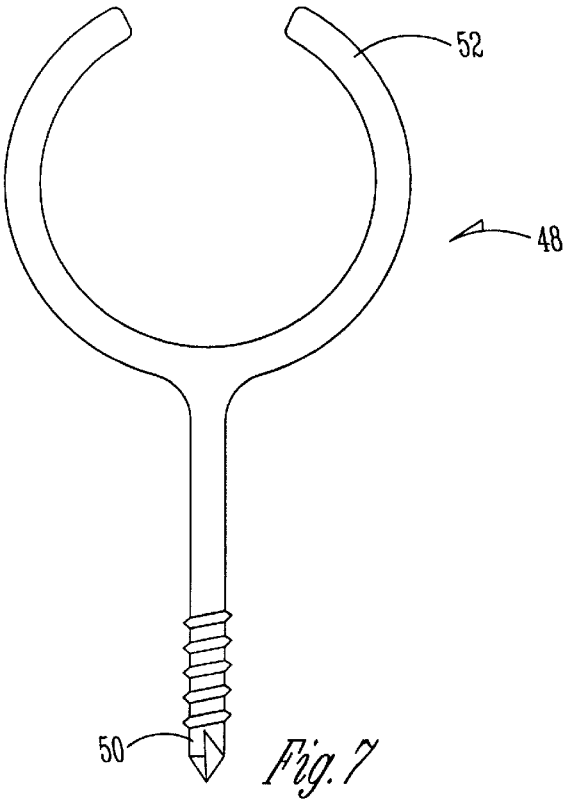
FIG. 7 is a top view of a mounting mechanism used with the portable urinal device of the present invention.

A mounting mechanism 48, as shown in FIG. 7, may also be used with the portable urinal device 10. The mounting mechanism 48 includes a first end 50 that is threaded such that the mounting mechanism may be screwed into the trunk of a tree or similar object. The second end 52 of the mounting mechanism 48 includes a C-shaped member forming an opening therewithin for receiving and holding the container 16 of the portable urinal device 10.

In operation, the portable urinal device 10 of the present invention is easy to use, does not require unnecessary movement, and effectively controls the odors associated with the disposal of urine. To use the portable urinal device 10, the hunter 12 or other user first raises the lid 24 to the open position. Next, the user slides the locking mechanism 30 so that its tongue portion 34 is inserted partially into the aperture 39 on the handle 22 of the container 16. With the lid 24 now locked in the open position, the user is free to urinate without worry that the lid 24 will close. Further, with the lid 24 hingeably mounted on the container 16, there is no risk that the lid will fall or separate from the container. Once the user has finished urinating, the user then slides the locking mechanism 30 forward so its tongue portion 34 no longer is in contact with the handle 22, and the lid 24 is then allowed to return to the closed position.

The container 16 and lid 24 of the portable urinal device 10 are preferably made from a rigid plastic. It is also preferred that the outside surface of both the lid 24 and the container 16 be texturized similar to tree bark for gripping purposes and also to blend into the environment. The portable urinal device 10 can also be camouflaged to help further blend the device with the environment.

From the foregoing description of the preferred embodiment, it can be seen that the present invention accomplishes at least all of its stated objectives and includes all of the aforementioned features.

What is claimed is:

1. A portable urinal device comprising:

a generally funnel-shaped container having a top end that is open;

a handle with an aperture on the container;

a lid hingeably mounted on the container for movement between a closed position covering the top end of the container and an open position, the lid includes a lever is biased toward the closed position; and a locking mechanism is slidably mounted on the lever and adapted to engage the aperture of the handle for locking the lid in the open position.

2. The portable urinal device of claim 1 wherein the container having a bottom end opposite the top end, the top end angled downwardly relative to the bottom end.

3. A portable urinal device comprising:

a generally funnel-shaped container having a top end that is open;

a handle on the container; and a lid hingeably mounted on the container for movement between a closed position covering the top end of the container and an open position, the lid biased in the closed position and including a lever and a locking mechanism;

wherein the locking mechanism is slidably mounted on the lever and includes a base wall with a tongue portion for engaging an aperture in the handle to lock the lid in the open position.

4. The portable urinal device of claim 3 wherein the lever further includes a top surface, a bottom surface, and an aperture with opposing edges, the locking mechanism further includes two opposing wings extending from the base wall that are biased against the edges to secure the locking mechanism to the lever.

5. The portable urinal device of claim 4 wherein each of the wings has a barb to grip the top surface of the lever.

6. The portable urinal device of claim 4 wherein the wings are sized smaller than the aperture of the lever, whereby the locking mechanism is allowed to slide along the edges of the aperture.

7. The portable urinal device of claim 3 further comprising a flexible gasket disposed between the container and the lid.

8. The portable urinal device of claim 7 wherein the flexible gasket is polyurethane.

9. The portable urinal device of claim 3 wherein the container terminates at a bottom end having a discharge nipple and the urinal device further comprises a fluid hose extending from the nipple.

10. The portable urinal device of claim 3 further comprising a mounting mechanism having a first end adapted to attach to a tree or like object and a second end forming an aperture for holding the container.

11. A portable urinal device for use on an elevated platform, such as a deer tree stand, the portable urinal device comprising:

a generally funnel-shaped container having a top end and a bottom end with an opening therethrough;

a lid hingeably mounted on the container for covering the top end, the lid is movable between an open position and a closed position, the lid is biased toward the closed position and includes a locking mechanism for slidably engaging aperture in a handle on the container and locking the lid in the open position;

a fluid hose having a first end and a second end, the first end is connected to the bottom end of the container and the second end is adapted for burying in the ground below the platform.

12. The portable urinal device of claim 11 further comprising a flexible gasket disposed between the container and the lid.

13. The portable urinal device of claim 12 wherein the flexible gasket is polyurethane.

14. The portable urinal device of claim 11 wherein the top end of the lid is angled downwardly.

15. The portable urinal device of claim 11 further comprising a mounting mechanism having a first end adapted to attach to a tree or like object and a second end forming an aperture for holding the container.

16. A method of disposing of urine from a hunting stand, the method comprising the steps of:

providing a portable urinal device having a generally funnel-shaped container with a top end that is open and a handle with an aperture therein, a lid hingeably mounted on the container for movement between a closed position covering the container and an open position, and a locking mechanism having a tongue portion slidably mounted to the lever;

providing a fluid hose having a first end and a second end;

connecting the first end of the fluid hose to the bottom end of the container;

burying the second end of the fluid hose underground;

opening the lid on the container;

sliding the locking mechanism to insert the tongue portion into the aperture in the handle;

urinating into the top end of the container;

sliding the locking mechanism to remove the tongue portion from the aperture in the handle; and closing the lid on the container.

* * * * *